US007360748B2

(12) United States Patent
Rosine et al.

(10) Patent No.: US 7,360,748 B2
(45) Date of Patent: Apr. 22, 2008

(54) ROTARY TABLE FOR ENCLOSED HOSE REEL

(75) Inventors: Lyle A. Rosine, Oswego, IL (US); Torrence Anderson, Overland Park, KS (US)

(73) Assignee: Suncast Corporation, Batavia, IL (US)

( * ) Notice: Subject to any disclaimer, the term of this patent is extended or adjusted under 35 U.S.C. 154(b) by 74 days.

(21) Appl. No.: 11/219,055

(22) Filed: Sep. 1, 2005

(65) Prior Publication Data

US 2007/0045502 A1 Mar. 1, 2007

(51) Int. Cl.
*A47B 91/00* (2006.01)

(52) U.S. Cl. ..... 248/349.1; 248/156; 248/508; 242/395

(58) Field of Classification Search ..... 248/349.1, 248/131, 145, 458, 521, 908; 242/395; 384/609; 108/103
See application file for complete search history.

(56) References Cited

U.S. PATENT DOCUMENTS

| | | | | |
|---|---|---|---|---|
| 177,367 | A | 5/1876 | Bartlett | |
| 848,239 | A | 3/1907 | Grimsrud | |
| 1,653,103 | A | 12/1927 | Keys | |
| 2,595,655 | A | 5/1952 | Hannay | |
| 2,779,642 | A * | 1/1957 | Matthews | 384/615 |
| 4,659,050 | A * | 4/1987 | Tabayashi | 248/349.1 |
| 4,697,778 | A * | 10/1987 | Harashima | 248/349.1 |
| 4,757,838 | A | 7/1988 | McGullion | |
| 4,777,976 | A | 10/1988 | Johnston et al. | |
| 4,793,376 | A | 12/1988 | Hare | |
| 4,946,127 | A * | 8/1990 | Kulaga | 248/551 |
| 5,000,513 | A * | 3/1991 | Schmidt | 297/440.11 |
| 5,080,322 | A | 1/1992 | Harley | |
| 5,109,882 | A | 5/1992 | Eley | |
| 5,179,972 | A | 1/1993 | Eley | |
| 5,205,521 | A | 4/1993 | Smith | |
| 5,330,121 | A | 7/1994 | Eley | |
| 5,335,687 | A | 8/1994 | Odom | |
| 5,390,695 | A | 2/1995 | Howard | |
| 5,404,900 | A | 4/1995 | Fletchall | |
| 5,462,298 | A | 10/1995 | Bodine | |
| 5,758,685 | A | 6/1998 | Tisbo et al. | |
| 5,779,309 | A * | 7/1998 | Lu | 297/344.26 |
| 6,050,290 | A | 4/2000 | Yacobi et al. | |
| 6,050,291 | A | 4/2000 | Whitehead et al. | |
| 6,478,265 | B2 | 11/2002 | Leach | |
| 6,669,135 | B1 | 12/2003 | Hartley | |

(Continued)

*Primary Examiner*—Ramon O Ramirez
(74) *Attorney, Agent, or Firm*—McHale & Slavin, P.A.

(57) ABSTRACT

A rotatable base apparatus for use with a hose reel enclosure. The base comprises an upper and a lower portion. A bearing is located in between the upper and lower portions and allows the portions to rotate with respect to each other. The bearing can comprise balls mounted in sockets in the lower base portion which ride in a track in the upper base portion. Clips are provided on the upper base portion to secure the hose reel enclosure thereto. This arrangement allows the user to remove the hose from the reel in any direction without the danger of the hose reel enclosure tipping over. The hose reel enclosure will rotate to the direction in which the hose is being removed. It also allows the hose reel enclosure to rotate to the direction that the hose is being wound onto the reel. This prevents the hose from being unevenly wound onto the reel, i.e. piling up on one side of the reel.

5 Claims, 19 Drawing Sheets

U.S. PATENT DOCUMENTS 6,742,740 B2 6/2004 Tisbo et al.
6,807,982 B1 10/2004 Ames
6,877,687 B2 4/2005 Moon et al.
6,913,221 B2 7/2005 Moon et al.
7,028,968 B2 * 4/2006 Washick ..... 248/521
7,032,811 B1 * 4/2006 Paulic et al. ..... 232/39
2004/0178314 A1 * 9/2004 Chen et al. ..... 248/349.1
2005/0017117 A1 1/2005 Moon et al.
2006/0054770 A1 * 3/2006 Lansdown ..... 248/349.1

* cited by examiner

ROTARY TABLE FOR ENCLOSED HOSE REEL

FIELD OF THE INVENTION

This invention pertains to reels for use in storage of flexible hoses and more particularly, to a hose reel having a pivotable base to allow the hose reel to turn in the direction the hose is being removed from or rewound onto the reel.

BACKGROUND INFORMATION

Portable hose reel dispensers for handling and storage of flexible water hoses, such as garden and air hoses, have gained wide public acceptance. While the construction of hose reels is quite varied, such reels are primarily constructed of molded plastic components having a centrally disposed rotatable spool for reeling of the flexible hose, and a frame for supporting of the spool. Recently there has been recognized a need for aesthetically pleasing hose reel storage devices. The hose and reel being mounted in an aesthetically pleasing enclosure. For more information concerning the structure and operation of these hose reel storage devices, reference may be made to U.S. Pat. Nos. 6,050,291 and 5,404,900 the teachings of which is hereby incorporated by reference. When the hose reel is located in the type of enclosure disclosed in U.S. Pat. No. 6,050,291 a problem arises with removal of the hose from the reel and winding the hose back onto the reel. If the hose is not substantially perpendicular to the reel when it is removed there is a tendency for the reel and enclosure to tip over on its side in the direction that the hose is being removed. Also, when the hose is wound back on the reel, if it is not substantially perpendicular to the reel there is a tendency for the hose to pile up on one end of the reel and not evenly distribute itself along the length of the reel.

U.S. Pat. No. 5,404,900 recognizes the problem of the hose not being substantially perpendicular to the reel when it is removed and wound back thereon. Swivel bolt 28, FIGS. 4 and 12, permit the reel to be turned toward the direction that the hose is lying, on the ground, to allow the hose to be evenly wound onto the reel.

U.S. Pat. No. 5,462,298 is directed to a hose reel cart which utilized a circular bearing surface to support an upper surface 34 on a lower surface 34. The hose and reel are mounted on the upper surface. This arrangement allows the hose and reel to pivot in the direction of use. However, an enclosure which will hold the reel and hide it from view is not provided by this device.

U.S. Pat. No. 6,478,265 is directed to a conventional wall-mounted bracket 10 which has a reel 12 for a hose. The bracket 10 is mounted onto a sleeve 32 which in turn is pivotally mounted on post 26. This arrangement allows the hose and reel to be pivoted to the direction of use. An enclosure for the hose reel is not provided and hence the reel is not aesthetically pleasing U.S. Pat. No. 5,080,322 discloses a turntable wherein the turntable element 10 and bearings 22 are made of plastics. Turntable element 10 is positioned between upper rotatable support board 12 and lower base board 14. A central shaft 8 passes through element 10 and rotatably connects the two boards so they can move freely relative to one another. In this patent, a television is placed on the upper support board and can rotate freely while the lower base board remains stationary. There is no indication that this could be used to support an hose and reel.

U.S. Pat. No. 4,757,838 discloses a swivel fire hose reel. A hose reel 14 is rotatably mounted to base 12 via swivel joint 28. When in storage the hose is fully supported by the reel 14. When the hose is pulled off the reel, the reel 14 and guard 16 will rotate so the hose may be deployed from the reel in the direction of the fire.

U.S. Pat. No. 6,807,982 discloses a garden hose storage device which is also used to transport the hose. The garden hose is held in compartment 26 located between outer cylindrical wall 14 and inner cylindrical wall 18. Inner wall 18 is attached to mounting post 30. Post 30 has a lower section 32 with a water inlet connector 34 and an axially aligned upper section 36 rotatably mounted on the lower section 32. Sections 32 and 36 are coupled together with a rotatable watertight coupling 38. The hose is removed from the storage device through hose guide 42. This does not allow for the deployment of the hose in any direction without applying an undue side force to the storage device.

These patents fail to teach or disclose a rotary table or base on which an enclosed hose reel can be mounted in accordance with the instant invention. What is lacking in the art is an enclosed hose reel which is pivotable so that the hose may be dispensed in various horizontal directions without tipping over the enclosure. Also, when the hose is wound back on the reel the pivotable base prevents the hose from rolling up on one side of the reel leaving the other side empty.

BRIEF DESCRIPTION OF THE INVENTION

Among the several aspects and features of the present invention may be noted the provision of a rotary base on which an enclosed hose reel is mounted. This permits the hose to be withdrawn from and wound back onto the reel from any angle. Since the object or objects which need water may not always be in front of the hose reel, the hose may have to be removed from the reel at a substantial angle relative to the front of the reel which will impose an undue side force on the reel and enclosure. This usually results in the entire hose enclosure tipping over onto its side. A similar problem exists when the hose is wound back onto the reel at a substantial angle from the front of the enclosure. The hose tends to pile up on one side of the reel so that the diameter of the hose on the reel will become larger that the allowable space within the hose enclosure. This results in the hose not being completely wound back onto the reel.

In one embodiment, resilient clips spaced around the rotary base are used to attach the hose reel enclosure to the rotary base. This prevents separation of the enclosure and base. In another embodiment sliding latches are utilized to attach the hose reel enclosure to the base. This provides for easy separation of the base and hose enclosure. In a further embodiment the base is integral with the hose reel enclosure.

Thus, it is an object of the instant invention is to provide a rotary base for an enclosed hose reel which will permit the hose to be removed from and replaced onto the reel without exerting any undue side force on the reel so as to result in the enclosure tipping over.

Another object of the invention is to provide a rotary base for an enclosed hose reel which includes resilient clips on the base for attaching the hose enclosure to the base. This permits easy and secure mounting of the hose reel enclosure.

A further object of the invention is to provide slidable latches on the rotary base for attaching the hose enclosure to the base. This permits relative easy removal of the hose enclosure from the base.

Other objects and advantages of this invention will become apparent from the following description taken in conjunction with the accompanying drawings wherein are set forth, by way of illustration and example, certain embodiments of this invention. The drawings constitute a part of the specification and include exemplary embodiments of the present invention and illustrate various objectives and features thereof.

DETAILED DESCRIPTION OF THE PREFERRED EMBODIMENTS

Figure 1:
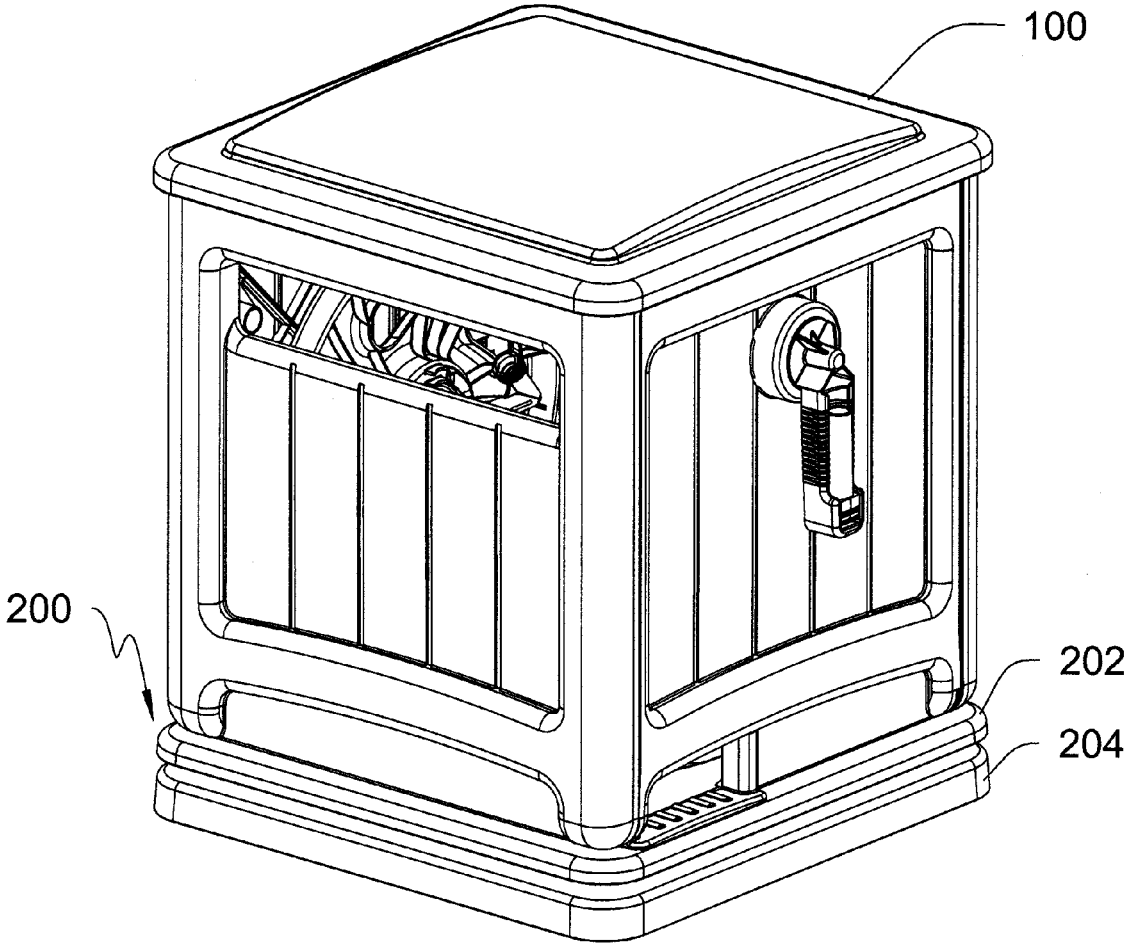
FIG. 1 is a perspective view of a hose reel enclosure mounted on a rotary base.
Figure 2:
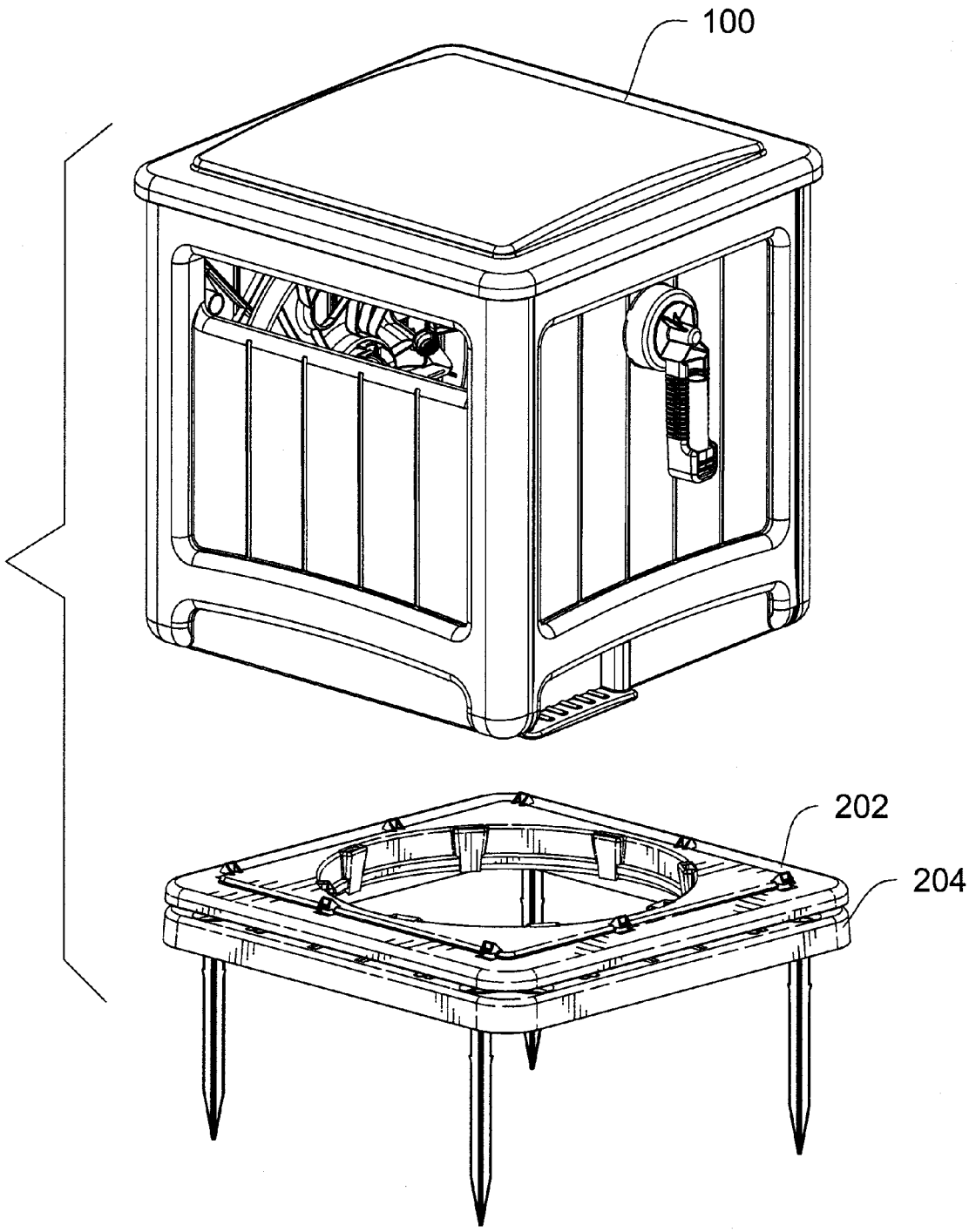
FIG. 2 is a perspective view of a hose reel enclosure prior to its mounting onto a rotary base.

While the present invention is susceptible of embodiment in various forms, there is shown in the drawings and will hereinafter be described a presently preferred, albeit not limiting, embodiment with the understanding that the present disclosure is to be considered an exemplification of the invention and is not intended to limit the invention to the specific embodiments illustrated.

Referring now to the figures, and generally to FIGS. 4-11, and 13-16 there are shown rotary base members 200, 300, 400 and 500 embodying the principles of the present invention. The rotary base members provide support for the hose reel enclosure 100 attached thereto. The preferred hose reel enclosure is disclosed in U.S. Pat. No. 6,742,740, the contents of which are incorporated herein by reference.

Figure 3:
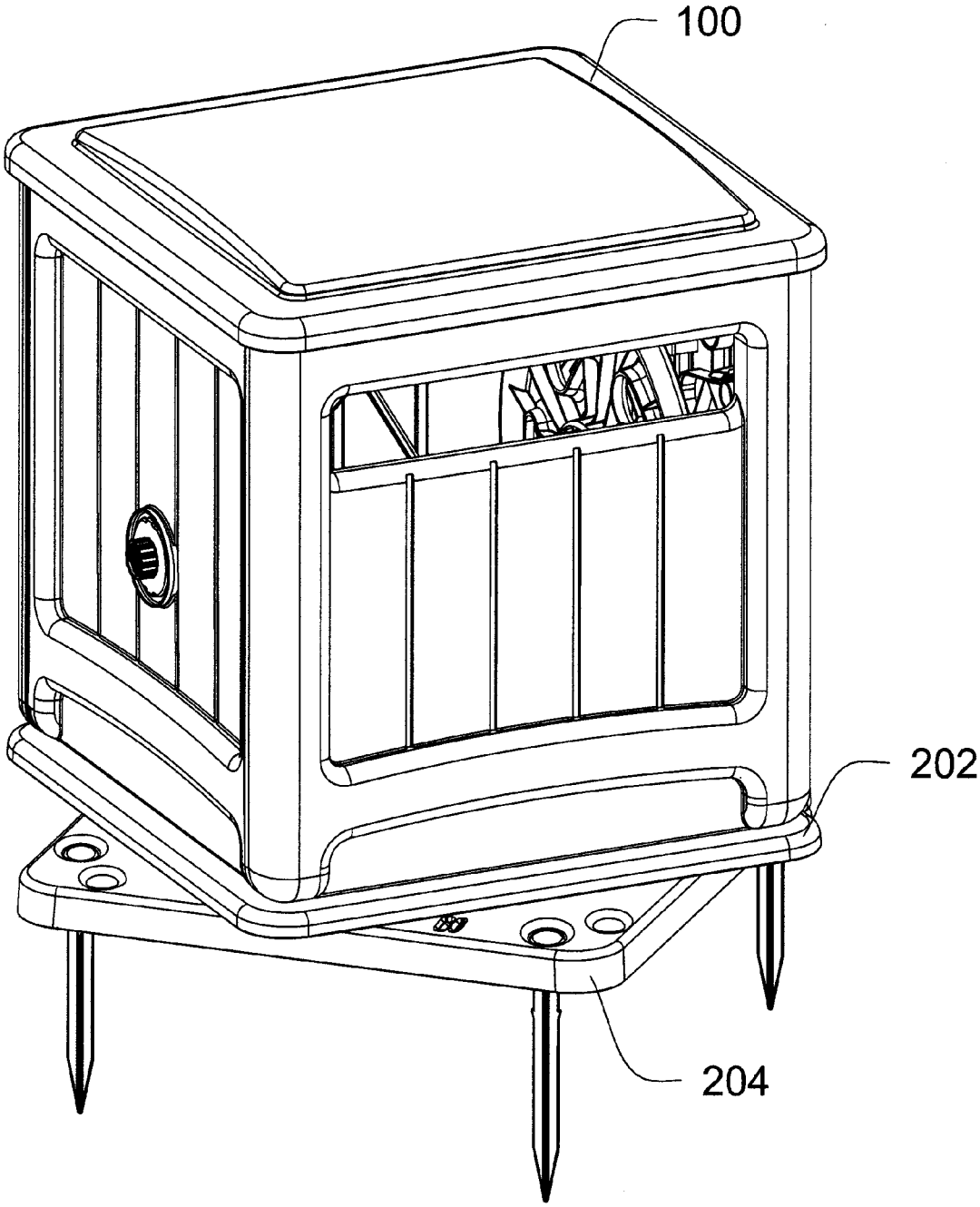
FIG. 3 is a perspective view of a hose reel enclosure mounted on the rotary base, the base having been rotated.
Figure 6:
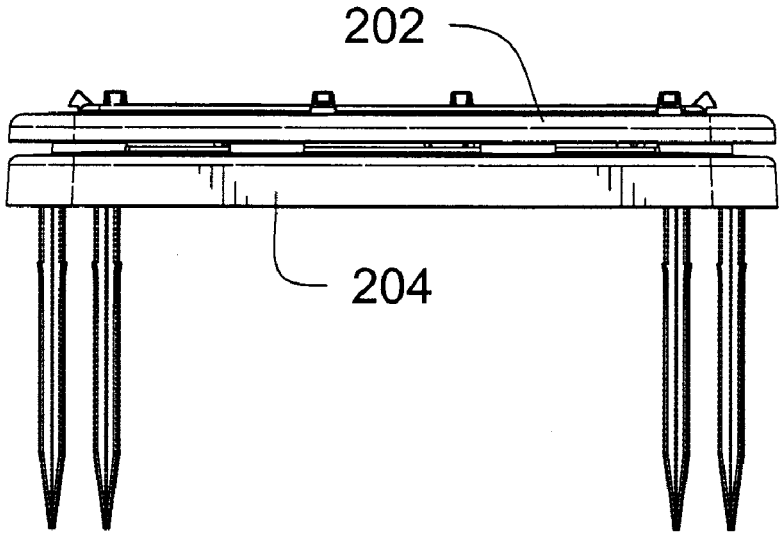
FIG. 6 is a front view of the rotary base.

In a preferred, albeit non-limiting embodiment, a hose reel enclosure 100 is attached to the upper base element 202 of rotary base member using clips 206 which can be integrally formed with the upper element or added as a separate element. These clips cooperate with the lowermost horizontal flanges on the bottom portion of the sidewalls of the hose reel enclosure, as illustrated in FIG. 6 of U.S. Pat. No. 6,742,740. Once the hose reel enclosure is securely attached to the upper element 202, the upper element 202 may be rotated relative to the lower base element 204. This is shown in FIG. 3 of the drawings. The enclosed hose reel may now be easily rotated in any direction so that the hose can be withdrawn from and wound onto the reel in a substantially perpendicular direction to the front face of the hose reel enclosure. This prevents the above noted problems of the enclosure tipping over or the hose piling up on one side of the reel.

Figure 7:
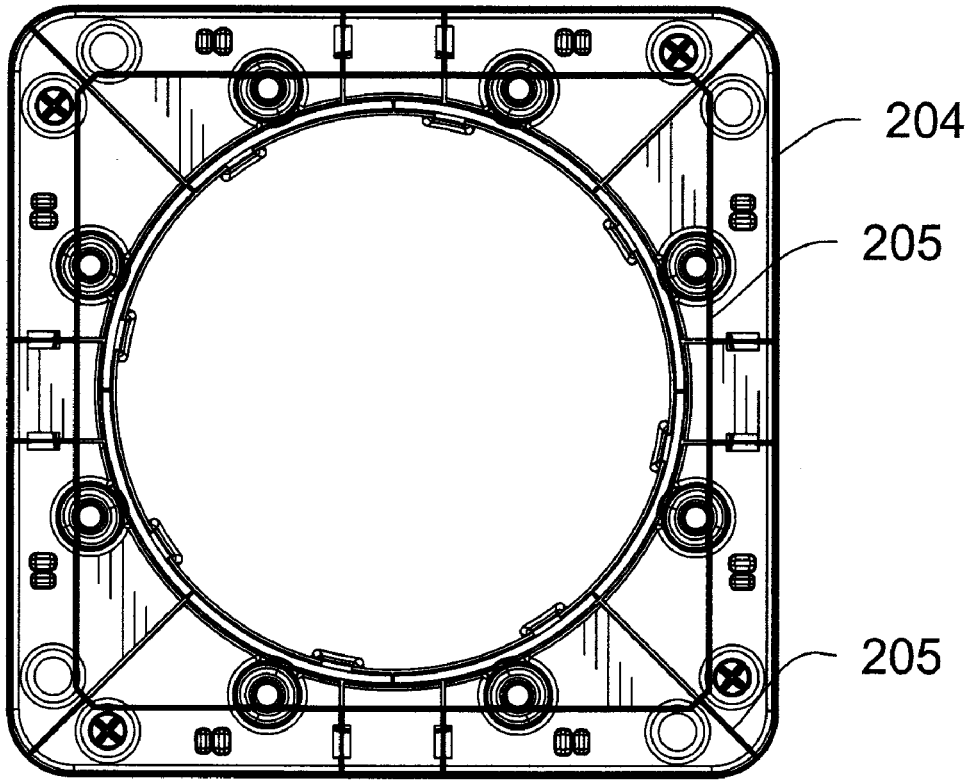
FIG. 7 is a view of the underside of the base.

The upper base element of the rotary base is supported on the lower base element utilizing a bearing. In the embodiment illustrated in FIGS. 10 and 11 the bearing comprises rotary balls 208 and circular track 212. The rotary balls 208 are located in sockets 210 in the top side of lower base element 204, They ride along on and support circular track 212, which is located in the underside of the upper base element 202. Circular track 212 comprises a pair of vertically extending, circular flanges 214. The bottom portions of the flanges 214 engage the top portions of the balls 208. Additionally, means are provided to rotatably attach the upper element to the lower base element. These are resilient clips 216 and circular flange 218 illustrated in FIG. 11. The clips 216 are formed integrally with the upper base element 202 and extend downwardly from the underside thereof. Circular flange 218 is formed integrally with the lower base element 204. Clips 216 are located on upper base element 202 in a circular pattern so as to fit within the inner circumference of flange 218. A lip 220 on the lower portion of clip 216 engages the lower circular edge portion of flange 218. This prevents separation of the upper and lower base elements once they are snapped together, while permitting rotation of the elements relative to each other. These base elements may be separated from each other by flexing clips 216 inwardly until lip 220 is no longer in engagement with the lower portion of flange 218. Strengthening ribs 205 are integrally formed in the lower portions of the upper and lower base elements 202 and 204, as shown in FIG. 7. This allows a smooth, aesthetically pleasing appearance on the upper portions of the upper and lower base elements.

Figure 8A:
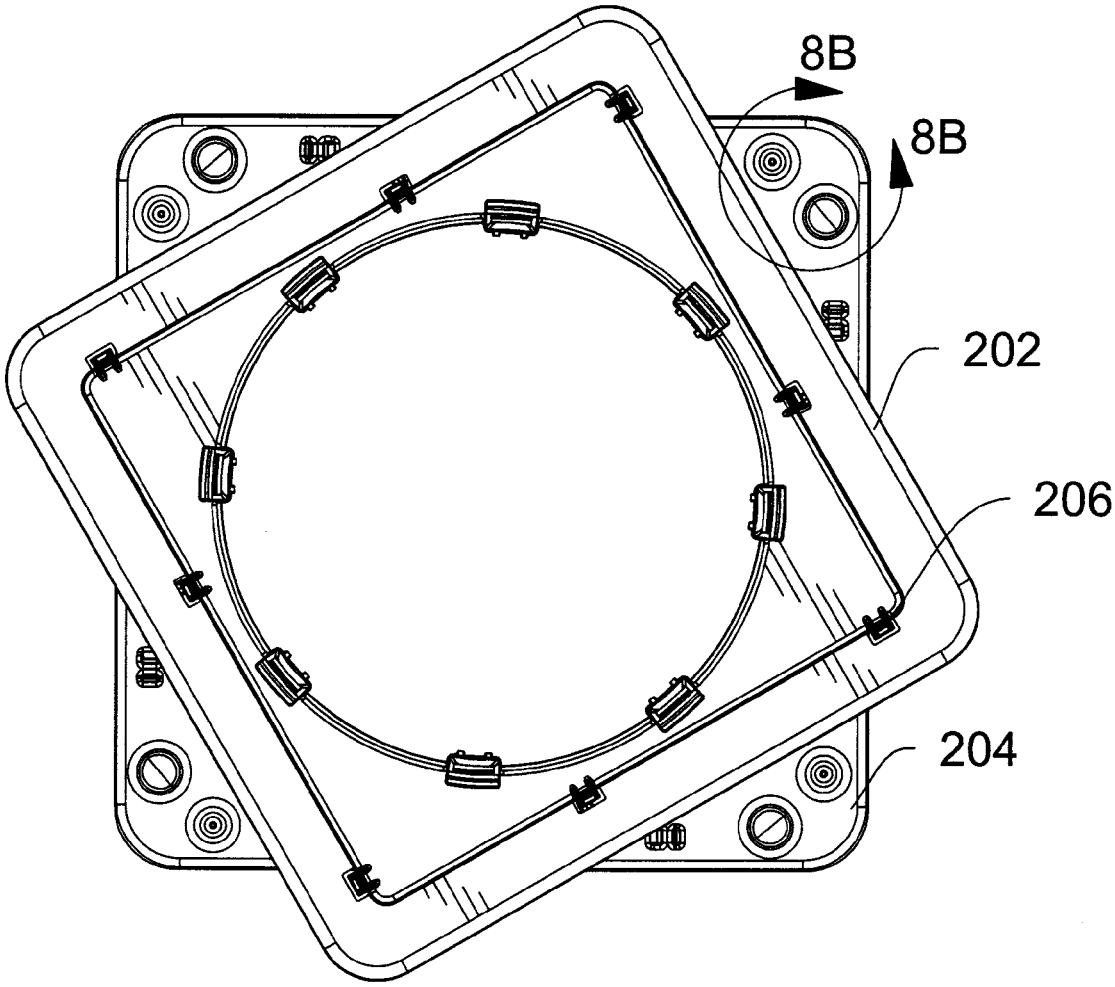
FIG. 8A is a top view of the base with the top portion rotated with respect to the lower portion.
Figure 8B:
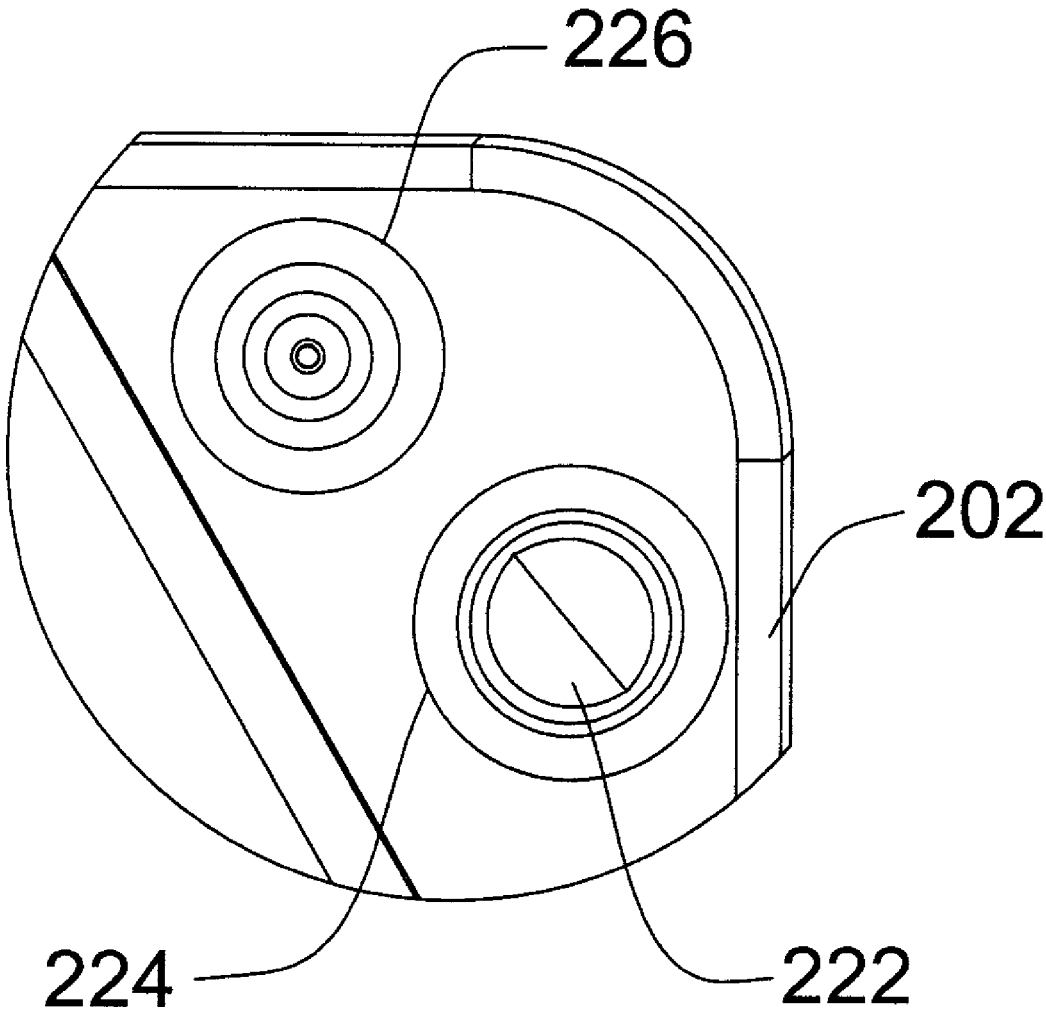
FIG. 8B is a cut-away view along line 8B-8B in FIG. 8A of an attachment feature of the base.
Figure 9:
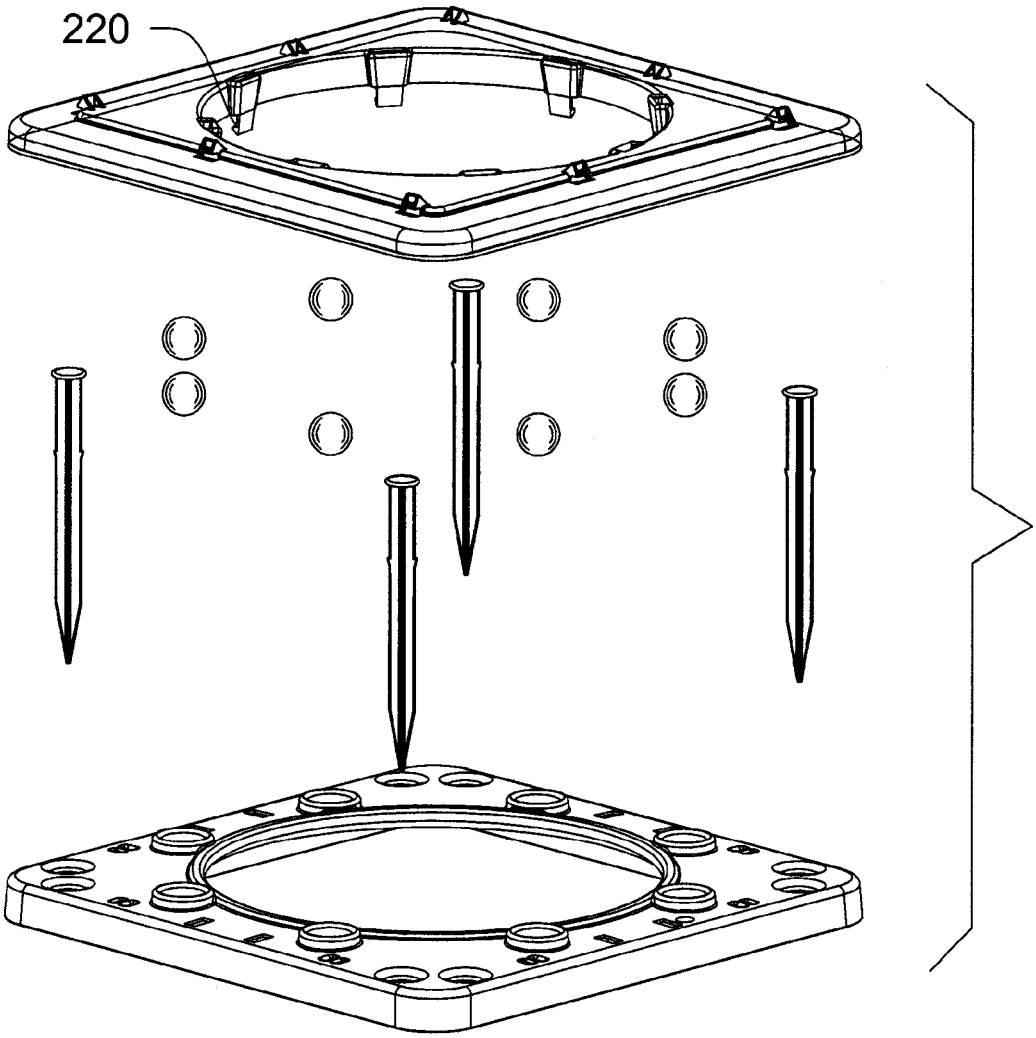
FIG. 9 is an exploded perspective view of the rotary base.
Figure 10:
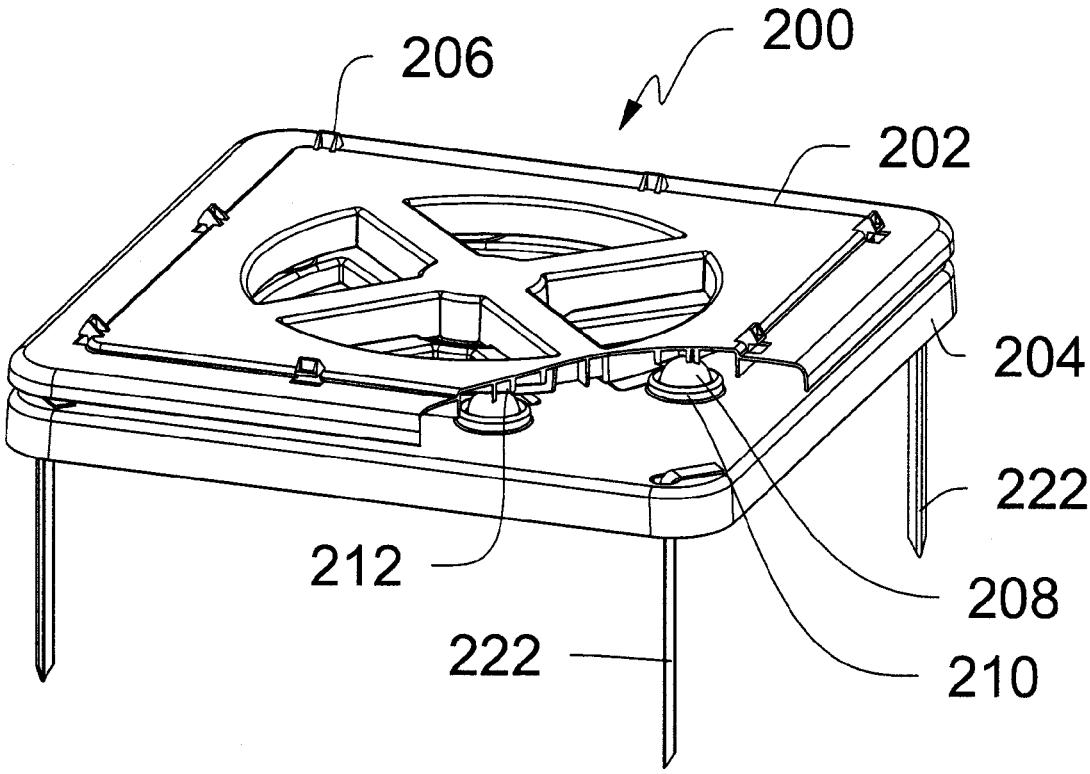
FIG. 10 is a perspective view of the rotary base including a partial cutaway section.
Figure 11:
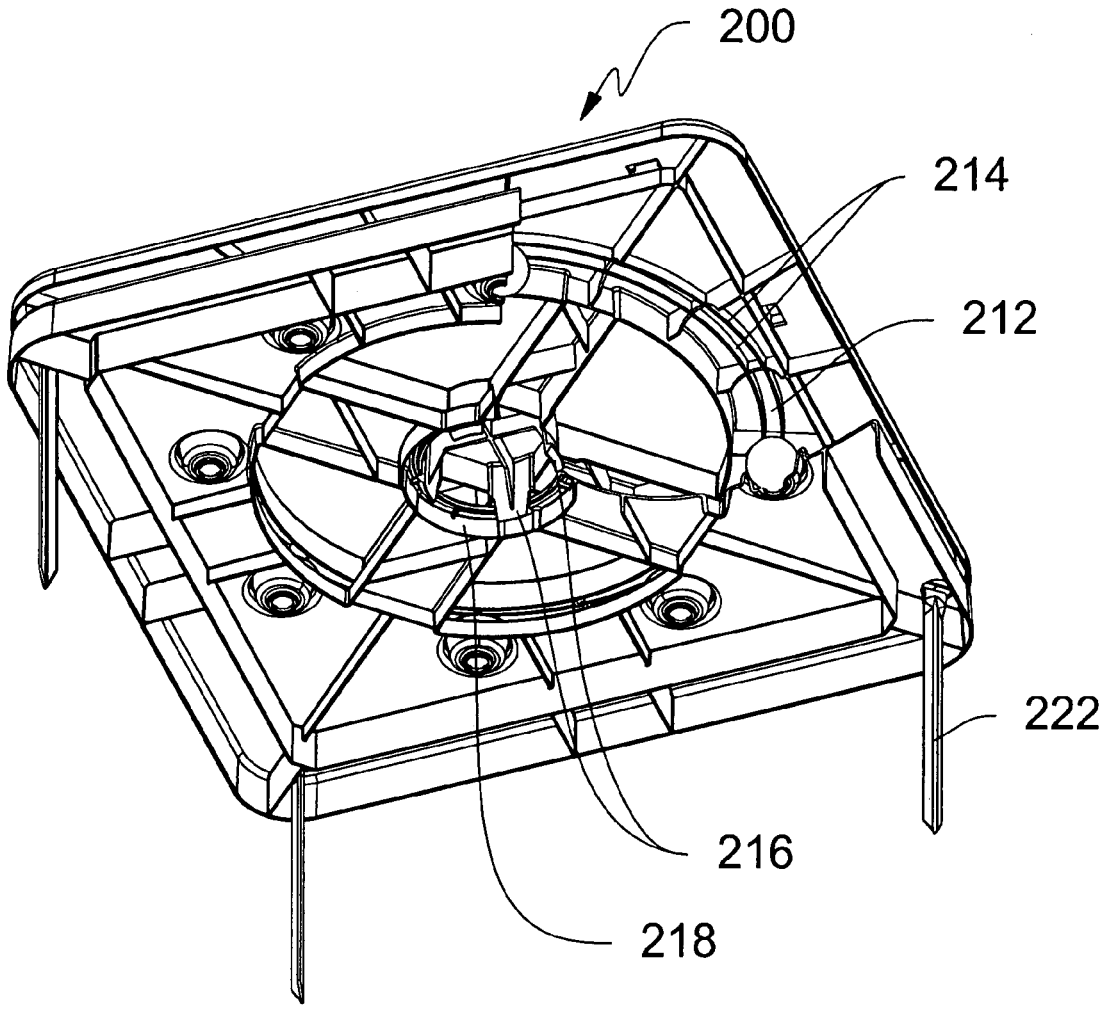
FIG. 11 is a perspective view of the underside of the rotary base including a partial cutaway section.

Stakes 222 anchor the lower base element to the ground. The stakes 222 pass through apertures 224 in the lower base element 204 as seen in FIG. 8B. The top of the stake 222 cooperates with the apertures 224 in the lower base element to anchor the lower base element to the ground. When a rotary force is exerted on the hose enclosure 100 it can freely rotate with respect to the ground since it ismounted on a rotary base 200. The lower element is also provided with apertures 226 which are formed as an aperture with a plurality or different diameter holes which can be punched out to accommodate different size fasteners, such as screws, bolts, nails, etc. These apertures are preferably integrally formed with the lower element but could be added after the manufacture of the lower base element. This provides a means to attach the lower element to structures, such as decks, and vehicles, such as cars, trucks, boats and planes.

Figure 13:
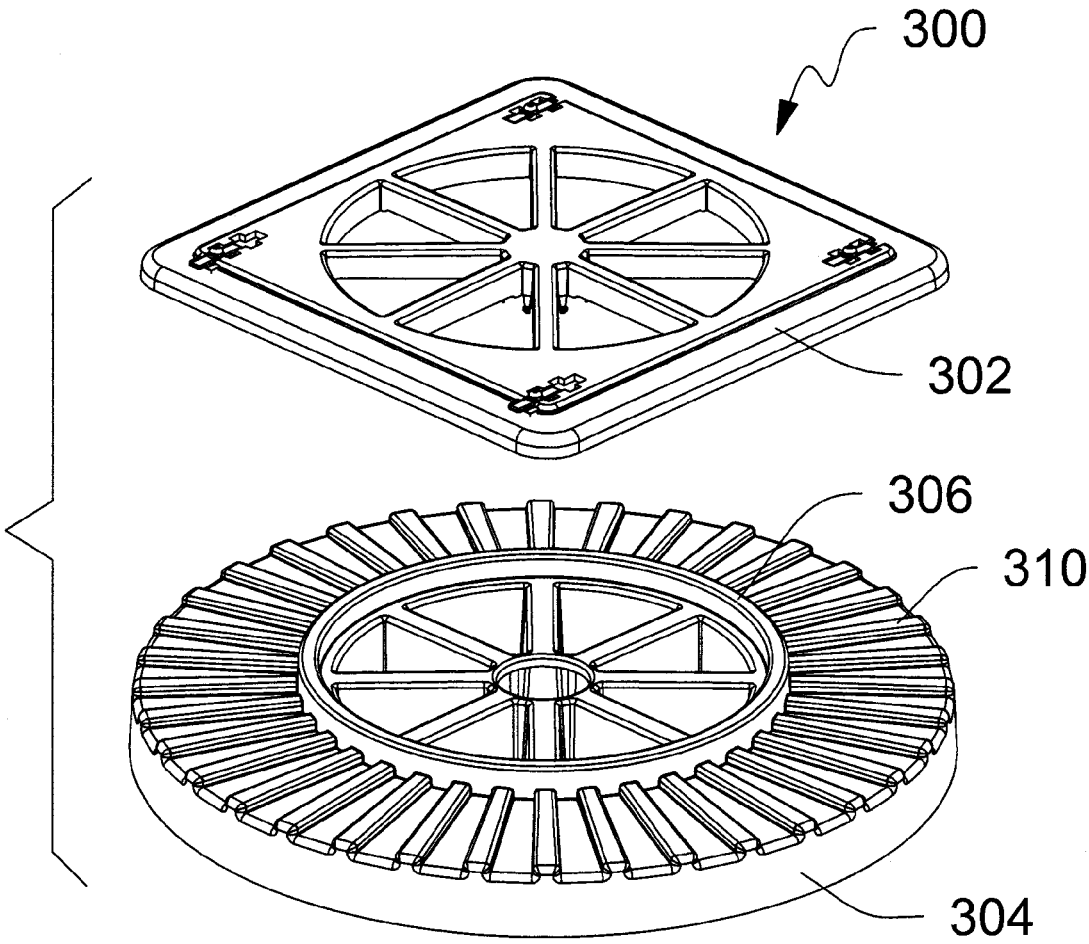
FIG. 13 is an exploded top perspective view of the base employing an alternative type of bearing.
Figure 14:
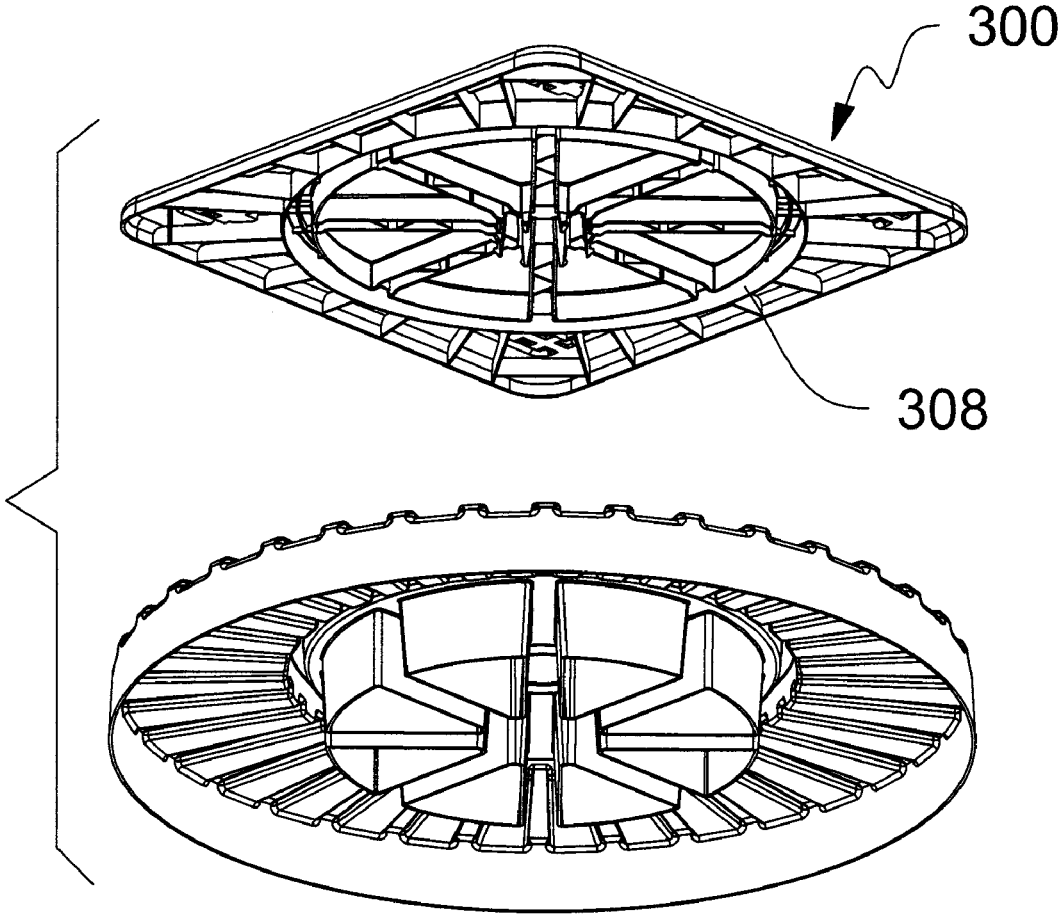
FIG. 14 is an exploded underside view of the base employing the alternative type of bearing shown in FIG. 13.

Another embodiment is illustrated in FIGS. 13 and 14. A circular bearing surface 306 is integrally formed on the top side of the lower base element 304. A circular track 308 is integrally formed on the underside of upper base element 302. Elements 306 and 308 are formed utilizing low friction materials to allow for relatively easy and smooth movement of one bearing surface with respect to the other bearing surface. Additionally lubricants may be utilized in between these bearing surfaces to provide for easy rotation of the upper and lower base elements. The upper and lower base elements are also connected together utilizing clips and a circular flange similar to elements 216 and 218 in FIG. 11. Strengthening ribs 310 are integrally formed in the top side of the lower element 304. Although not shown, the lower base element 304 is formed similar to lower base element 204 and can be provided with apertures 224 and 226. These apertures provide a means to anchor the lower base element to a surface.

Figure 15:
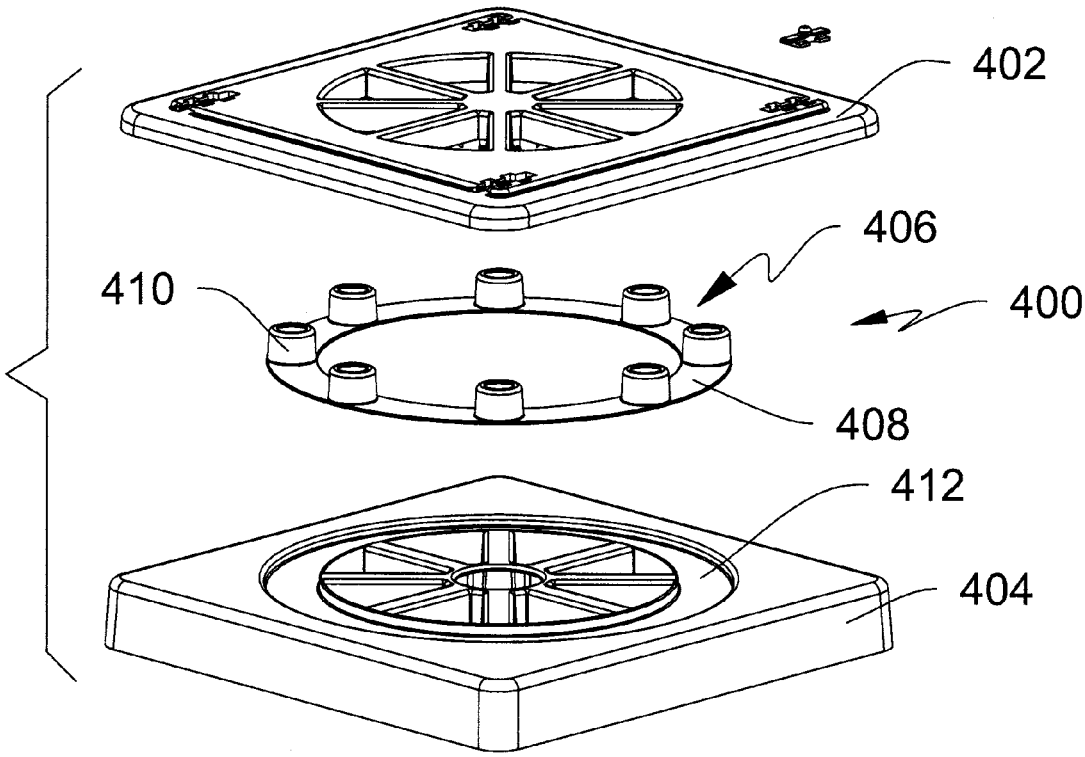
FIG. 15 is an exploded perspective view of the base employing a second alternative type of bearing.

A further embodiment is illustrated in FIG. 15. A race 406 is positioned between upper base element 402 and lower base element 404. The race comprises a circular base portion 408 onto which cylindrical ball retention members 410 are formed. Balls are located within ball retention members 410. A portion of the ball protrudes below the lowermost portion of the ball retention member 410 and circular base portion 408. This protruding portion of the ball rides in track 412 which is formed in the top side of the lower base element 404. The circular base portion 408 also rides in track 412. Another portion of the ball protrudes above the ball retention member 410. The diameter of the hole at the top of the ball retention member 410 is selected such that only a small portion of the ball protrudes above the ball retention member. This protruding portion of the ball rides in a track which is formed in the underside of the upper base element 402. The race 406 enables the even distribution of the balls along track 412. Upper and lower base elements are also connected together utilizing clips and a circular flange similar to elements 216 and 218 shown in FIG. 11.

Figure 4:
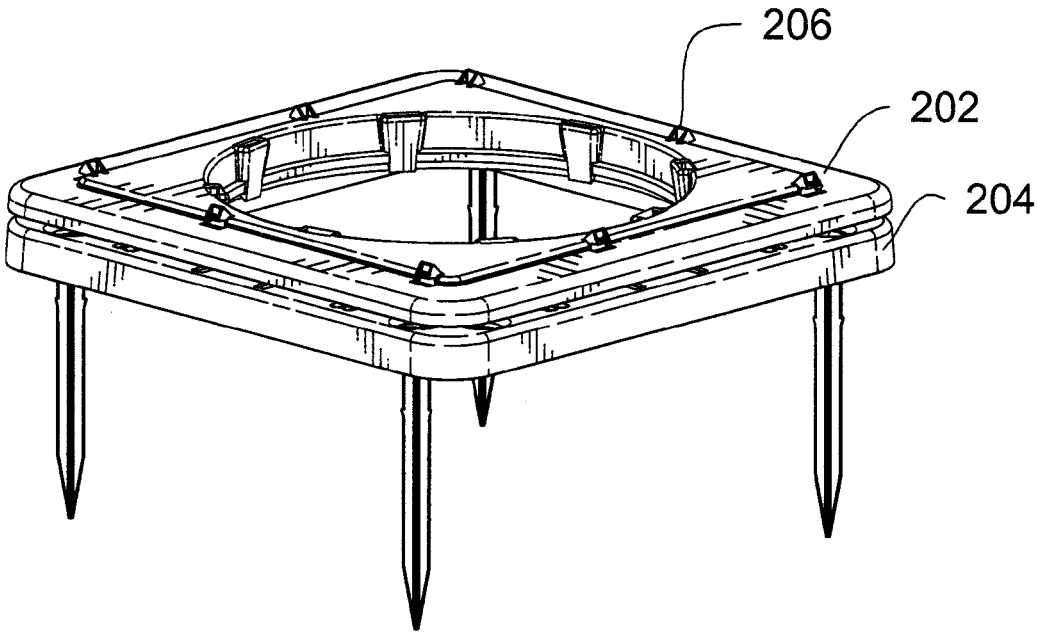
FIG. 4 is a perspective view of the rotary base.
Figure 5:
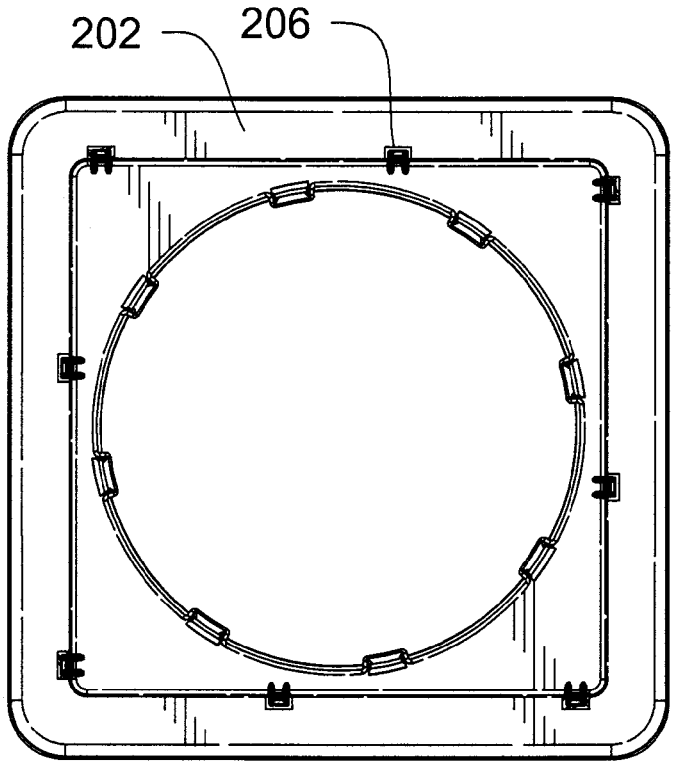
FIG. 5 is top view of the rotary base.
Figures 12A, 12B, 12C:
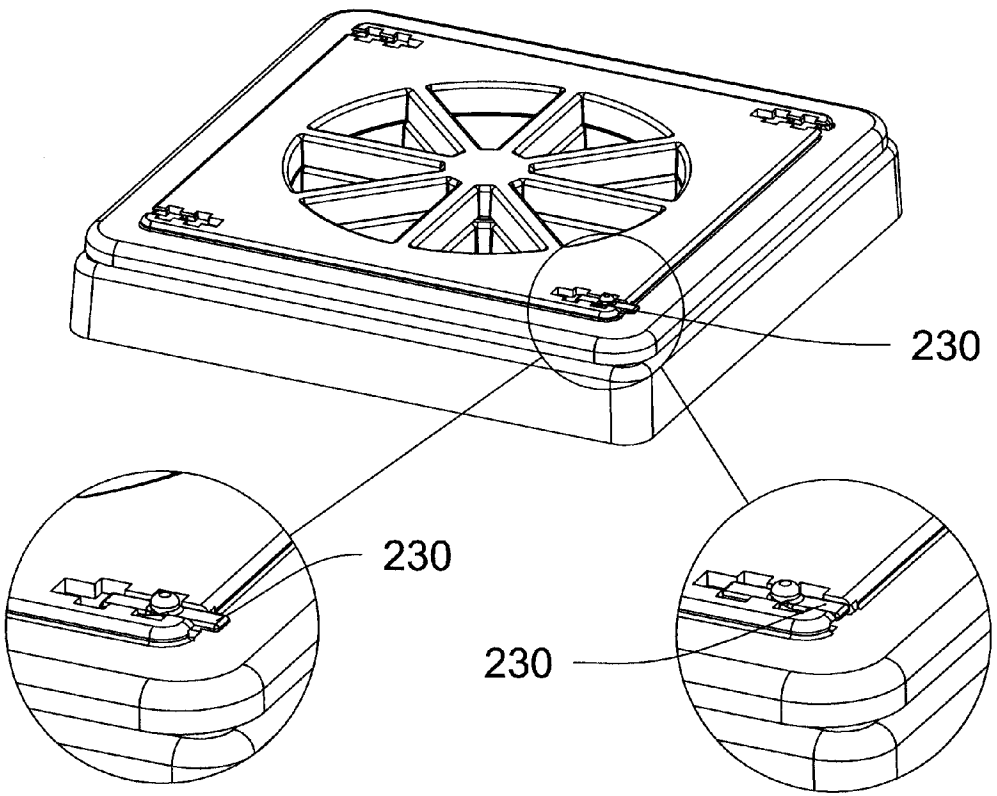
FIG. 12A is a perspective view of the rotary base illustrating an alternative type of latch.
FIG. 12B is a cut-away view of the alternative latch in a position wherein the hose reel enclosure can be released from the base.
FIG. 12C is a cut-away view of the alternative latch in a position wherein the hose reel enclosure is attached to the base.

In another embodiment, illustrated in FIGS. 12A, 12B, and 12C latches 230 are used in place of the clips 206 of FIG. 4. The latches 230 engage the same lowermost horizontal flanges on the bottom portion of the sidewalls of the hose reel enclosure that clips 206 engage. The latches are slidable from a retracted position, shown in FIG. 12B, to an extended position, shown in FIG. 12C. In the extended position, the latches 230 engage the lowermost horizontal flanges of the hose reel enclosure securing the hose reel enclosure to the upper element of the rotary base. The hose reel enclosure and the upper base element can now rotate together as one unit. In the retracted position, the latches 230 do not engage the lowermost horizontal flanges of the hose enclosure. The hose reel enclosure can now be removed from the upper base element. Since the hose reel enclosure in relatively hollow, as illustrated in the U.S. Pat. No. 6,742,740, latches 230 are readily accessible. Other conventional fasteners, not shown, could be utilized in place of latches 230.

Figure 16:
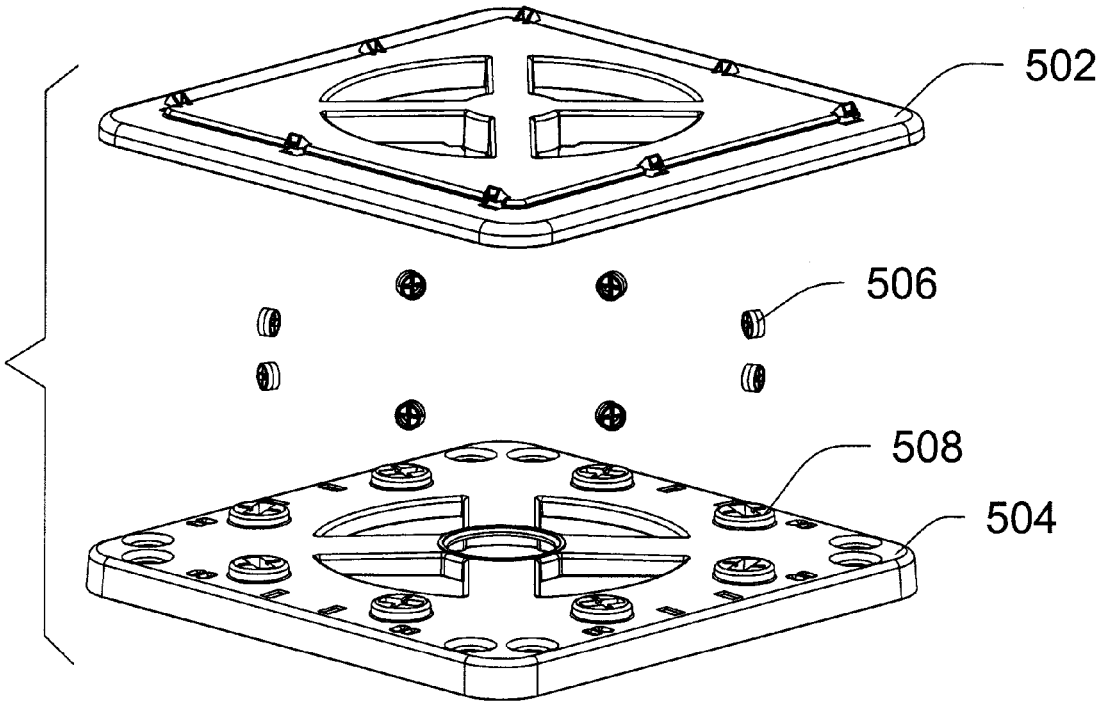
FIG. 16 is an exploded perspective view of the base employing rollers for the bearing arrangement.

FIG. 16 illustrates a further embodiment wherein rollers 506 are employed as the bearings. The rollers are held in position by sockets 508 which provide a support for the axis of roller 506 to rotate in. These sockets are positioned in a substantially circular pattern on the top surface of the lower base element 504. A substantially circular track (not shown) is located on the underside of the upper base element 502 in alignment with the circular pattern of rollers. Since the rollers do not allow for movement in a direction transverse to the direction of rotation, there is practically no horizontally, transverse movement of the upper and lower base elements with respect to each other.

Figure 17:
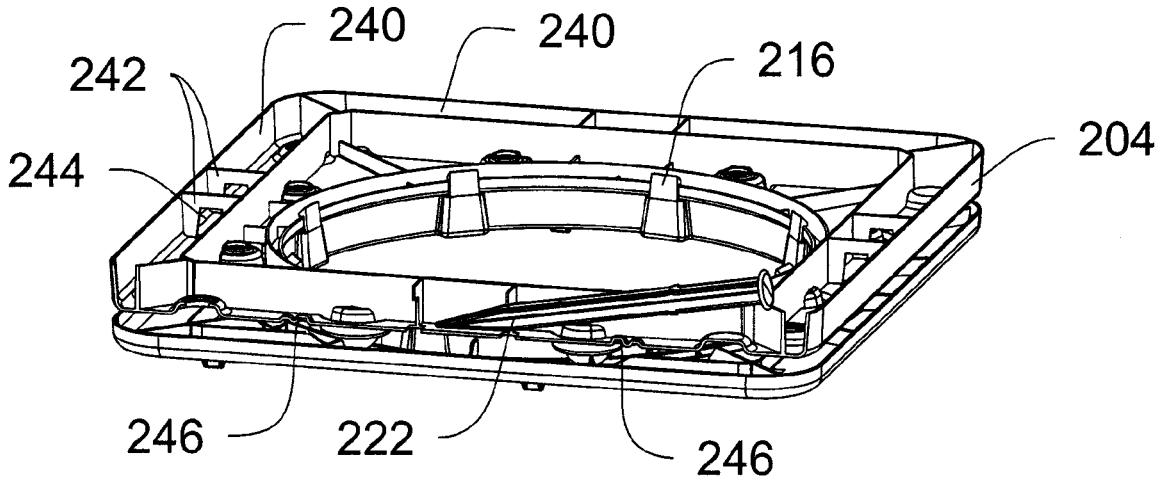
FIG. 17 is a perspective view of the underside of the upper element of the base illustrating a spike being inserted into its stowed away position.
Figure 18:
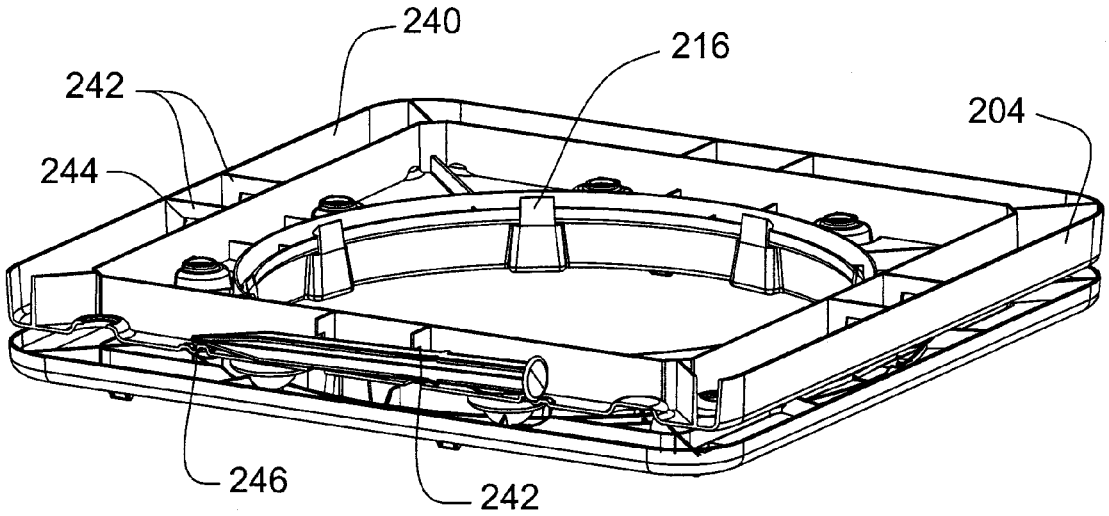
FIG. 18 is a perspective view of the underside of the upper element of the base illustrating a spike in its stowed away position.
Figure 19:
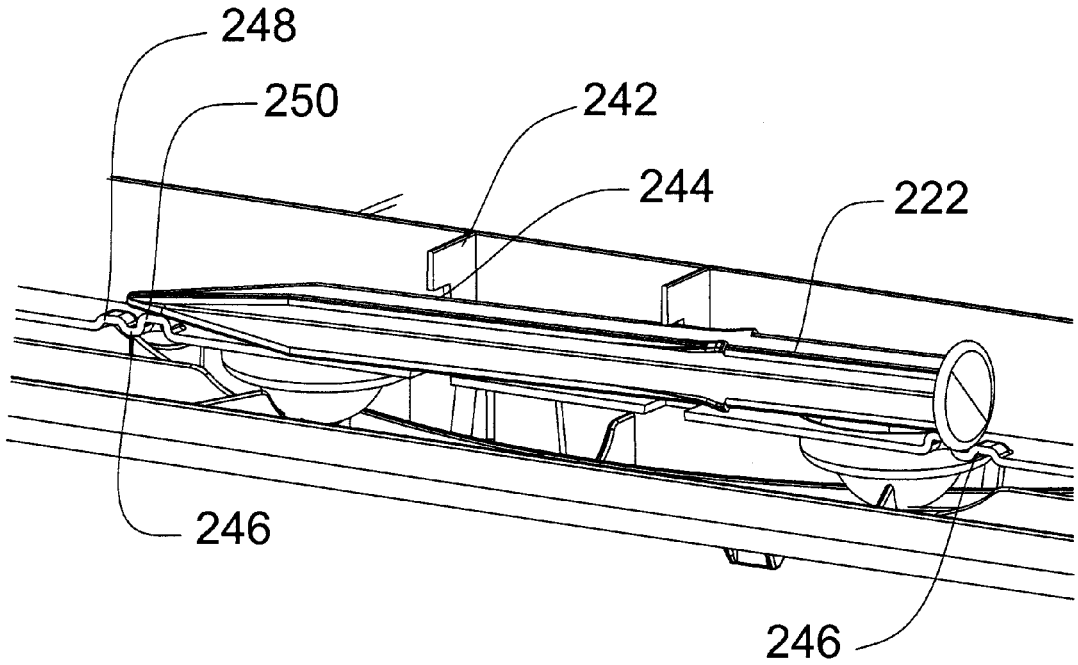
FIG. 19 is an enlarged perspective view of a spike in its stowed away position.
Figure 20:
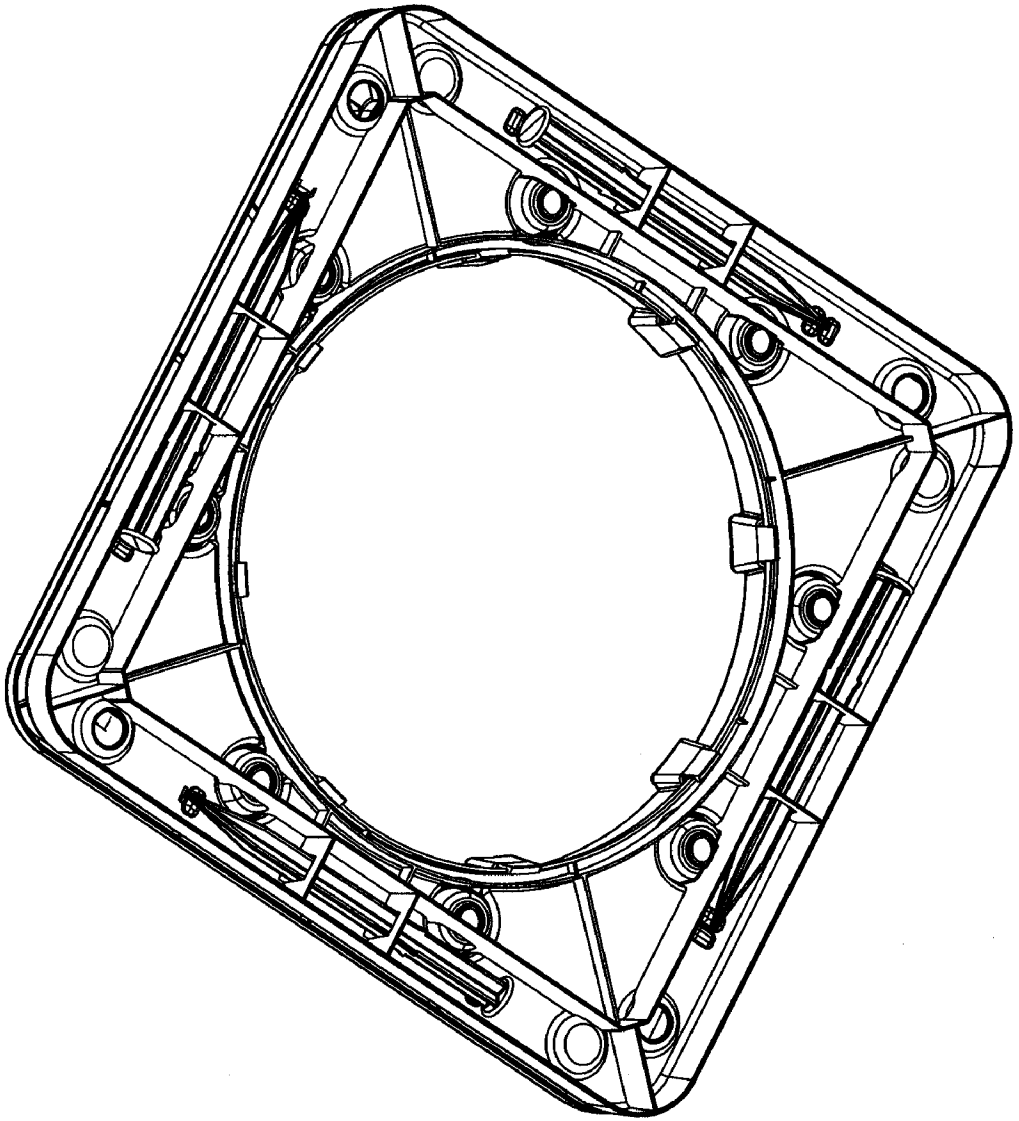
FIG. 20 is a perspective view of the underside of the upper element of the base with all four spikes in their stowed away position.

FIGS. 17-19 illustrate the unique feature of the invention wherein a storage area is provided for stakes 222. Channels 240 are provided around the periphery of the underside of lower base element 204. Retainers 242 are located in the central portion of the channels substantially midway between the ends of the channels. The retainers are provided with an aperture 244 for the receipt of a stake 222. The lower portions of the channels are provided with a plurality of raised supports 246 which together with the retainers 242 function to hold the stakes in place during shipping and storage after the stakes have been removed from apertures 224. The supports are formed with two raised portions 248 and 250. They are of different heights. The taller portion 250 is located closer to the mid-portion of the channel 240. The top of the stake is located in between the portions 248 and 250, as shown in FIG. 19. The lower tip of the stake rests on portion 250 during shipping, as shown in FIG. 19. The retainers 242 exert a downward pressure, as seen in FIG. 19, on the stake 222. Supports 246 exert an upward pressure on the stake. In addition portions 248 and 250 provide support for the top of the stake so it cannot move longitudinally in channel 240. The combination of these forces enable the stakes to be frictionally held in their storage positions in channels 240.

As will be appreciated by those skilled in the art from a study of the figures and the above description, the base members 200, 300, 400, and 500 are formed primarily from molded components. In a present form, the base members 200, 300, 400, and 500 are formed primarily from high density polyethylene (HDPE) using an injection molding process. Those skilled in the art will recognize that there are various other materials that can be used to form the base members 200, 300, 400, and 500 components and various other processes by which the components can be made, which other materials and process are within the scope of the present invention.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A base for rotatably supporting a hose reel comprising:

upper and lower base elements each having an axis of rotation which is substantially perpendicular to a substantially planar surface of said upper and said lower base elements;

said upper base element rotatably mounted to said lower base element about said axis of rotation, said lower base element utilizing a bearing means, said bearing means comprising in combination a track and a bearing surface positioned on the underside of said upper base element and the top side of said lower base element to provide means to rotatably support said upper base element on said lower base element;

means to attach said upper base element to said lower base element;

said means to attach comprising clips extending downwardly from the underside of said upper base element;

a circular flange extending through the lower base element;

wherein said clips cooperate with a lowermost edge of said circular flange to prevent separation of said upper and said lower base elements and allow rotary motion of said base elements with respect to each other and said upper base element including means to attach a hose reel thereto.

2. A base for rotatably supporting a hose reel comprising;

upper and lower base elements each having an axis of rotation which is substantially perpendicular to a substantially planar surface of said upper and said lower base elements;

said upper base element rotatably mounted to said lower base element about said axis of rotation, said upper base element is rotatably mounted to said lower base element utilizing a bearing;

said upper base element including means to attach a hose reel thereto;

a means to attach said upper base element to said lower base element, said means to attach comprising clips extending downwardly from the underside of said upper base element, a circular flange extending through the lower base element, wherein said clips cooperate with a lowermost edge of said circular flange to prevent separation of said upper and said lower base elements and allow rotary motion of said base elements with respect to each other.

3. A base for rotatably supporting a hose reel comprising;

upper and lower base elements each having an axis of rotation which is substantially perpendicular to a substantially planar surface of said upper and said lower base elements;

said upper base element rotatably mounted to said lower base element about said axis of rotation; and said upper base element including means to attach at least two side panels having a hose reel rotatably supported therebetween thereto, said means to attach at least two side panels having a hose reel therebetween to the upper base element comprising fasteners spaced around the circumference of the top side of said upper base element, whereby said fasteners are constructed and arranged to secure said at least two side panels to said upper base element.

4. The base in accordance with claim 3 wherein said fasteners are clips.

5. The base in accordance with claim 3, wherein said fasteners comprise a plurality of slidable latches spaced around the circumference of the top side of said upper base element.

* * * * *